United States Patent [19]

Laroche

[11] 4,336,938

[45] Jun. 29, 1982

[54] GAME INCLUDING APERTURES SIMULATING PLAYING CARDS SELECTED BY A ROLLED BALL

[75] Inventor: Paul G. Laroche, Lauderdale By The Sea, Fla.

[73] Assignee: Glenhope Enterprises, Inc., Fort Lauderdale, Fla.

[21] Appl. No.: 259,002

[22] Filed: Apr. 30, 1981

Related U.S. Application Data

[63] Continuation of Ser. No. 61,825, Jul. 30, 1979, abandoned, which is a continuation-in-part of Ser. No. 911,430, Jun. 1, 1978, abandoned.

[51] Int. Cl.[3] ..... A63F 5/02

[52] U.S. Cl. ..... 273/138 R; 273/123 R; 273/120 R

[58] Field of Search ..... 273/138 R, 139, 115, 273/120 R, 142 F, 113, 116, 123 R

[56] References Cited

U.S. PATENT DOCUMENTS

| | | | |
|---|---|---|---|
| 152,036 | 6/1874 | Eggleston | 273/115 |
| 725,118 | 4/1903 | Mueller | 273/123 R |
| 795,049 | 7/1905 | Maier | 273/123 R |
| 1,014,936 | 1/1912 | Bettin | 273/123 R |
| 1,299,391 | 4/1919 | Sylvester | 273/123 R |
| 1,314,623 | 9/1919 | Wagner | 273/120 R |
| 1,850,045 | 3/1932 | Achor | 273/115 |
| 2,001,500 | 5/1935 | Rothen | 273/138 R |
| 2,390,458 | 12/1945 | Pedersen | 273/115 X |
| 3,295,852 | 1/1967 | Dunn | 273/115 |
| 3,877,700 | 4/1975 | Moe | 273/138 R X |

FOREIGN PATENT DOCUMENTS

| | | | |
|---|---|---|---|
| 740231 | 5/1943 | Fed. Rep. of Germany | 273/138 R |
| 762283 | 1/1934 | France | 273/142 F |
| 240816 | 5/1946 | Switzerland | 273/138 R |

*Primary Examiner*—George J. Marlo
*Attorney, Agent, or Firm*—John Cyril Malloy

[57] ABSTRACT

A game of chance including one or two balls of predetermined diameter and a gameboard wherein the gameboard defines a generally dish-shaped symmetrical central zone bounded by an outer peripheral zone defining a race path; the gameboard has a raised outer circular rim and the central zone has 52 recesses sized to receive the ball; and the recesses are arranged in 4 concentric circles containing 6, 10, 16 and 20 recesses, respectively, so that, the surface being smooth, a ball is adapted to be rolled on the raceway and, under the influence of gravity, it will enter the central zone to be received by random choice in one of a plurality of the recesses. Gate members may be provided to direct the ball from the raceway onto the central zone in a generally radial path. The recesses are provided with indicia representing conventional playing cards for purposes of scoring. Sockets are located in the rim bounding the peripheral zone with scoring indicia to facilitate score keeping by movement of scoring pegs progressively along the plurality of sockets.

5 Claims, 4 Drawing Figures

GAME INCLUDING APERTURES SIMULATING PLAYING CARDS SELECTED BY A ROLLED BALL

This invention is a continuation of the earlier patent application of the applicant for an IMPROVED PLAY GAME, Ser. No. 061,825, filed July 30, 1979 now abandoned, and a continuation-in-part of the copendng patent application of the applicant for an IMPROVED PLAY GAME, Ser. No. 911,430, filed June 1, 1978.

FIELD OF THE INVENTION

This invention relates to an improved gameboard for use in combination with spherical play pieces for use in combination in playing an interesting game of skill and chance.

BACKGOUND OF THE INVENTION

In the past there have been numerous types of gameboards. This invention is of a improved gameboard which includes a circular dish-shaped central playing zone within which there is a pattern of recesses to receive spherical balls to be rolled circumferentially over an inclined peripheral zone which enter the central zone in a ransom fashion. The balls will then roll downwardly over the central zone under the influence of gravity until coming to rest in one of the holes. The holes are arranged in concentric rings and assigned values which requires the players exercise some skill and judgment with a knowledge of the forces of gravity and geometry in order to play correctly. The score is one of chance however; and is not dependent upon control.

OBJECTS OF THE INVENTION

It is, generally speaking, an object of this invention to provide an improved gameboard which provides an interesting and educational game to be played with spherical balls. Use of it requires a skill and knowledge of geometry and the effects of gravity forces on rolling balls in order to play well, and a score keeping arrangement of pegs and holes whereby the players can keep score conveniently.

It is a general object of this invention to provide an improved highly educational interesting game of chance which is simple in construction, inexpensive to manufacture and well adapted for the purposes for which it is intended.

In accordance with these and other objects which will become apparent hereinafter, the instant invention will now be described with reference to the accompanying drawings in which:

Figure 1:
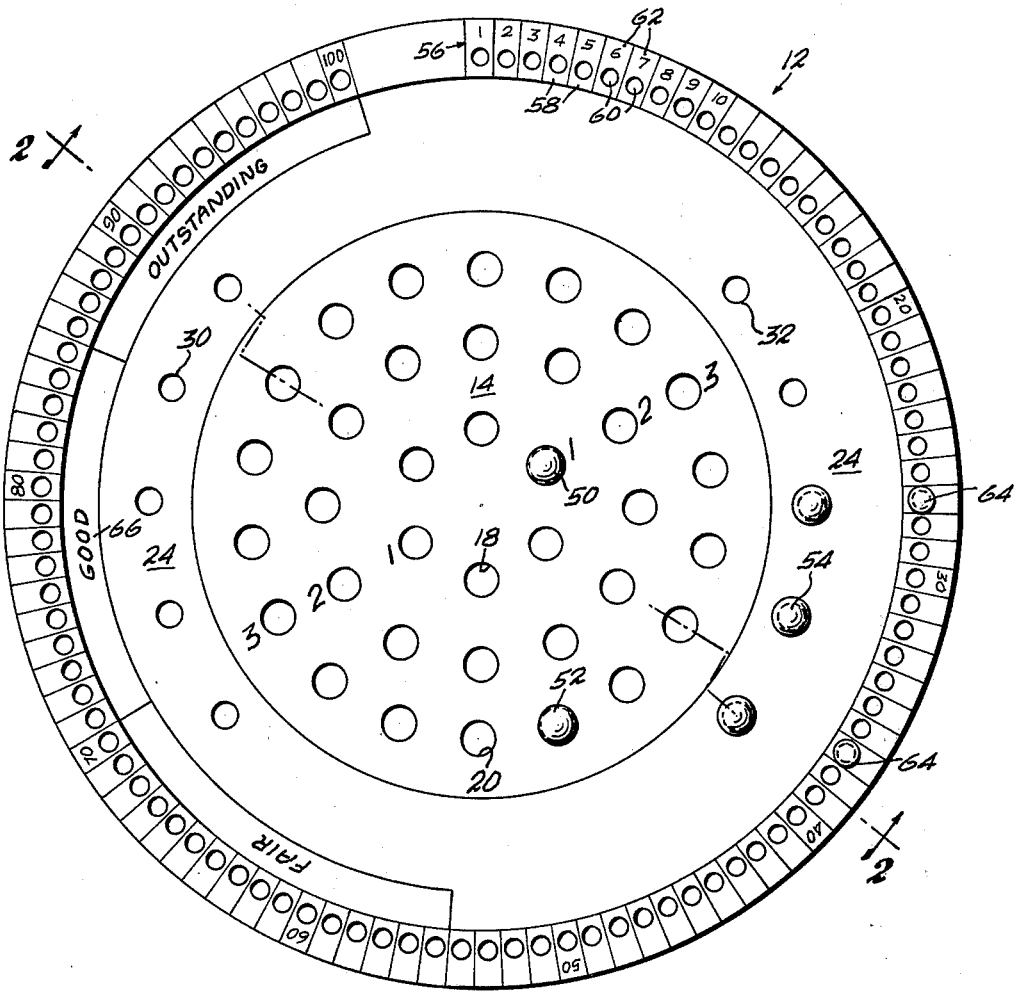
FIG. 1 is a top plan view of a first embodiment of the play game of the present invention.
Figure 2:
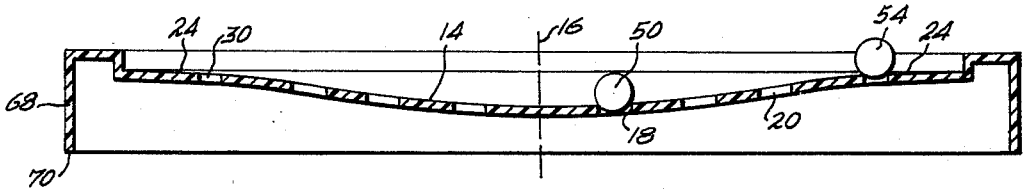
FIG. 2 is a view in cross section taken on the plane indicated by the line 2—2 of FIG. 1 and looking in the direction of the arrows.

DECRIPTION OF FIRST PREFERRED EMBODIMENT OF FIGS. 1 and 2

Referring to the drawings wherein like reference characters designate like or corresponding parts throughout the several views, there is shown a dish-shaped gameboard 12 having a dish-shaped central zone which is circular as seen in plan and is designated by the numeral 14. The vertical centerline of the dish-shaped central zone is illustrated and designated by the numeral 16. The dish-shaped central zone is defined by a surface having a relatively constant radius of curvature from a center on the central line and in the playing zone there are a plurality of holes arranged in concentric rings of diminshing radii between the outermost ring 20 and the innermost ring 18. For each ring indicia indicate a quantitative value as will be explained hereinafter. About the central zone there is a play piece station peripheral zone which is annular and which is designated by the numeral 24. Within this ring there are a plurality of hole, preferably somewaht smaller in size than the holes in the central zone, which holes are designated by the numerals 30, 32, for example. Spherical balls are placed in each of the holes of the play piece station. The balls being designated by the numerals 50, 52, 54, for example. A player flicks one of the balls into the dish-shaped central recess, where it will roll downwardly under the influence of gravity and the pushing force to ultimately come to rest in one of the holes which will represent, by its location and the indicia of the ring in which the hole is located, a quantitative value. About the gameboard, peripherally located, there is a ring 56 which is segmented into a plurality of arcuate sections 58, in each of which there is at least one hole 60 and indicia 62 indicating quantitative values. Alternatively, there may be two rows of holes 60. The players keep score by moving game pegs 64 from one hole to another as the game progresses, with the hole in which the peg is located representing the total value which has been earned by the player. Different colored pegs are used by each player. Additionally, indicia 66 may be provided in the outer part of the play station zone to indicate whether the score of the player is "fair," "good," or "outstanding."

It will thus be seen that there is provided a simple and inexpensive game which is highly useful for playing a game of chance wherein the skill of the player is a factor and wherein an understanding of the forces of gravity and geometry are required in order to master the same, however, the score is a result of chance. In this preferred embodiment, there is a downwardly extending skirt 68 which extends from the upper surface of the gameboard to a lower foot surface 70. While the invention has been shown and described in a preferred embodiment, it is recognized that the gameboard as a whole may be solid or that the same may be hollow within the skirt and be made of plastic, wood, or any other suitable material.

DESCRIPTION OF SECOND PREFERRED EMBODIMENT OF FIGS. 3 AND 4

Figure 3:
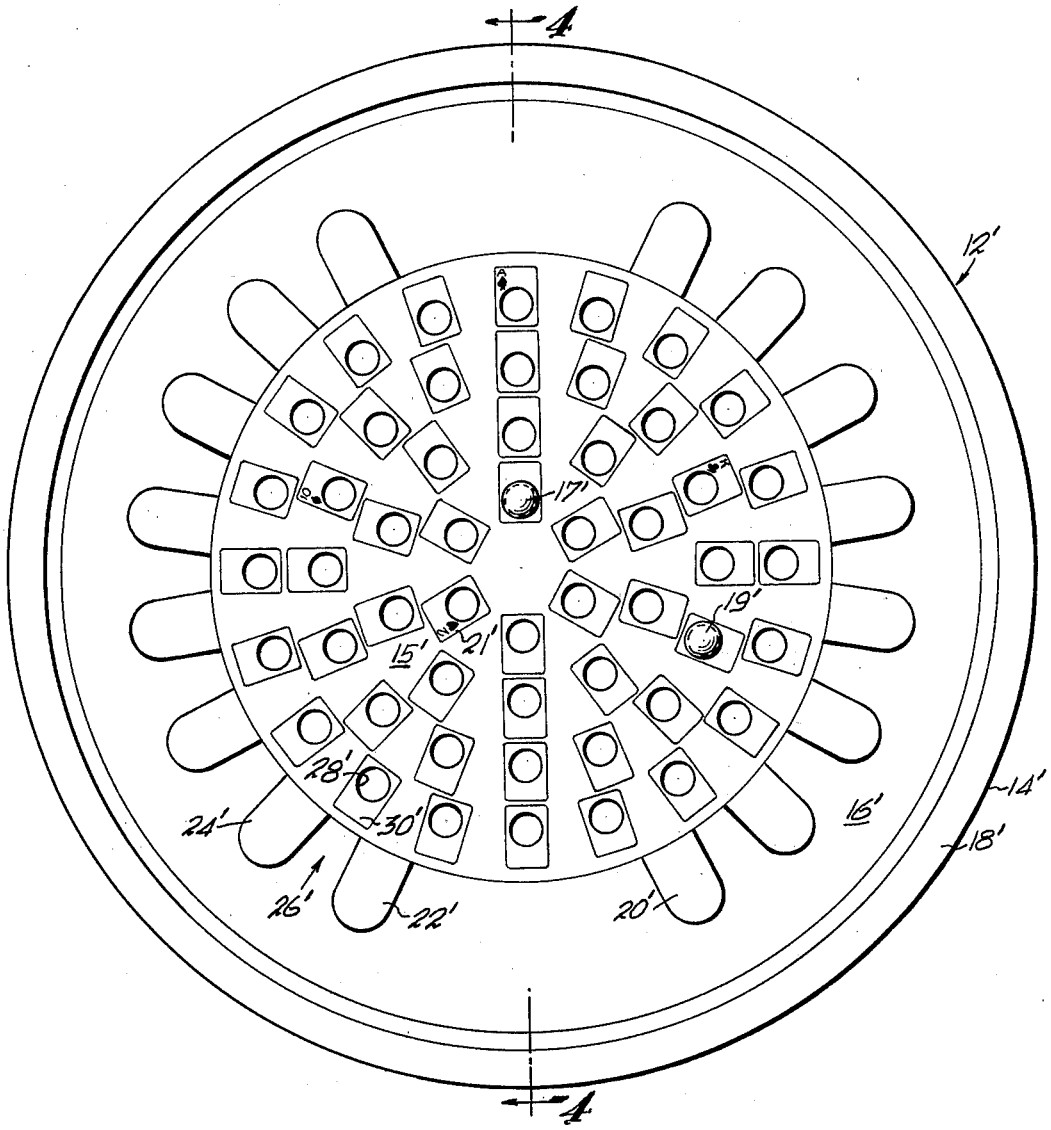
FIG. 3 is a top plan view of a second and alternative embodiment of the play game of the present invention.
Figure 4:
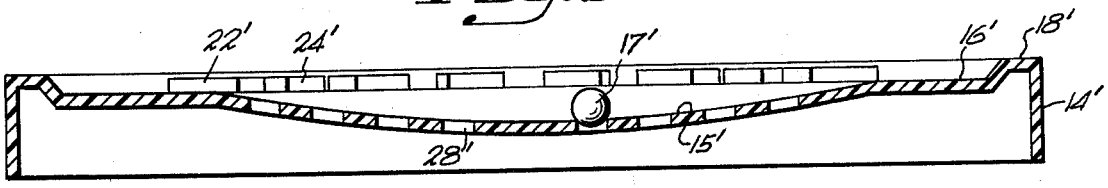
FIG. 4 is a view in cross section taken on the plane indicated by the line 4—4 of FIG. 3 and looking in the direction of the arrows.

Referring now to FIGS. 3 and 4, it is seen that there is provided a second alternative embodiment generally designated by the numeral 12' wherein a set of balls, such as the balls indicated by the numerals 17' and 10', which are of predetermined and similar diameter, are provided for use with the gameboard. The gameboard defines a generally dish-shaped surface and, more specifically, the surface is circular as seen in plan and is symmetrical with respect to a vertical centerline of the circular game surface. The surface has a central zone 15' and an outer peripheral zone 16' about the central zone, the latter peripheral zone defining a race path. About the peripheral zone there is a raised outer circular rim 18' which has a downwardly depending skirt 14' ending at the terminal end upon which the gameboard may be supported. The surface of the central zone is generally smooth and having a plurality of recesses, such as the recess designated by the numeral 28' arranged in spaced relation from one another, preferably in spaced circular lines about the center. These recesses are adpted to receive the ball such as 17' or 10' as indicated in FIGS. 3 and 4. In the preferred embodiment illustrated, the sockets or recesses 28' are sized to nest the balls, the same being of a diameter slightly less than the diameter of the balls, as shown. Extending radially outwardly on the race path adjacent the central zone, toward but not to the rim, there are a circular array of projections forming a plurality of gate members such as 20', 22' and 24' so that, when a ball is rolled over the raceway, it will be under the influence of gravity and enter between the gate members as indicated by the arrowed line 26' in a generally radial path to roll over the central zone until received in one of the recesses. In this manner the game may be played, either with one or two balls rolled in opposite directions of rotation from a central zone until they hit each other to be repelled, in the case of steel balls particularly, backwardly until entering between two of the gate members such as 22' and 24' as shown and rolling over the surface. Preferably each of the sockets or recesses is provided with an indicia such as that indicated by the numeral 21', which may resemble the cards of a conventional deck of playing cards. To this end, a zone 30' may be provided about the socket as an indicia generally representing a playing card.

While the instant invention has been shown and described in two preferred embodiments with indicia in the form of numbers representing the holes in the central playing zone, it will be understood that, in additon to these indicia additional or alternative symbols may be utilized. In any event there has been provided an interesting and inexpensive game which is highly educational and provides the unique combination of skill and chance; and indeed may be utilized to play the well known game of Blackjack. It is recognized that departures may be made within the spirit and scope of this invention which is therefore not to be limited except as set forth in the claims which follow within the doctrine of equivalents.

What is claimed is:

1. A game of chance including a smooth spherical ball having a predetermined diameter, said game of chance including:

a gameboard having a generally concavely dish-shaped play surface, and said gameboard play surface being generally circular and symmetrical with respect to a vertical centerline through the play surface, said play surface having a smooth concave central zone free and clear of upstanding projections, and an outer peripheral zone about the central zone, said central zone being characterized by a first common radius of curvature having a center on the vertical centerline, said peripheral zone having a generally smooth surface defining a circular race path, said race path being free and clear of upstanding projections and said race path being characterized by a second common radius of curvature longer than said first radius of curvature, and said second radius of curvature having a center on the vertical centerline, the central zone having a plurality of recesses arranged in a plurality of four rings of recesses, (a) an inner ring, (b) an outer ring, (c) a ring between said inner and outer rings and adjacent said inner ring, and (d) a ring between said inner and outer rings and adjacent said outer ring, said inner ring being composed of six recesses, said outer ring being composed of 20 recesses, and said ring between said inner and outer ring and adjacent said inner ring being composed of 10 recesses, and said ring between said inner and outer ring and adjacent said outer ring being composed of 16 recesses, each of the recesses having a predetermined common diameter less than the diameter of the ball and adpated to nestingly receive and releasably captivate the ball, the recesses of each ring being equispaced from one another and said rings being equispaced from one another, and, the portion of the central zone within the inner ring being an uninterrupted smooth concave surface, whereby when the ball, when rolled over the race path enters the central zone, will travel toward the portion of the central zone within the inner ring under the influence of gravity, to be received either in one of the plurality of recesses through random selection or come to rest in the portion of the central zone bounded by said inner ring, an outer annular rim about the race path to constrain a ball traveling over the path to eventual movement under the influence of gravity toward the cental zone, and, said gameboard having a portion extending away from the play surface and the annular rim and defining a support surface for supporting said gameboard in a substantially horizontal attitude.

2. The device as set forth in claim 1 wherein said outer annular rim is provided with a plurality of score recesses, and indicia adjacent each of said score recesses of a preassigned value and said score recesses being adapted to receive a peg sized to be inserted therein and moved from score recess to score recess for the purposes of keeping score.

3. The device as set forth in claim 1 wherein on said peripheral zone and between said circular race path and central zone, a plurality of spaced radially extending portions are provided each comprising a gate member to direct the ball from the race path and onto the central zone toward said recesses in a generally radial path.

4. The device as set forth in claim 1 wherein said second radius of curvature is such that said peripheral zone is inclined slightly.

5. The device as set forth in claim 1 wherein adjacent each of said recesses, an indicia is provided selected from and representing one of the conventional indicia on a conventional game of playing cards.

* * * * *